US007526882B2

(12) United States Patent
Rhenter

(10) Patent No.: US 7,526,882 B2
(45) Date of Patent: May 5, 2009

(54) SELECTIVELY DAMPING PLANTAR INSOLE

(76) Inventor: Jean-Luc Rhenter, Route du Village, 1195 Bursinel (CH)

( * ) Notice: Subject to any disclaimer, the term of this patent is extended or adjusted under 35 U.S.C. 154(b) by 396 days.

(21) Appl. No.: 10/567,052

(22) PCT Filed: Aug. 5, 2004

(86) PCT No.: PCT/FR2004/002089

§ 371 (c)(1),
(2), (4) Date: Feb. 2, 2006

(87) PCT Pub. No.: WO2005/013746

PCT Pub. Date: Feb. 17, 2005

(65) Prior Publication Data

US 2006/0185197 A1 Aug. 24, 2006

(30) Foreign Application Priority Data

Aug. 5, 2003 (FR) ..... 03 09746

(51) Int. Cl.
*A61F 5/14* (2006.01)
*A43B 13/38* (2006.01)

(52) U.S. Cl. ..... 36/174; 36/180; 36/43; 36/44

(58) Field of Classification Search ..... 36/174, 36/180, 43, 44, 166, 173, 182
See application file for complete search history.

(56) References Cited

U.S. PATENT DOCUMENTS

| | | | | |
|---|---|---|---|---|
| 4,128,950 | A | 12/1978 | Bowerman | |
| 4,364,189 | A | 12/1982 | Bates | |
| 4,551,930 | A | 11/1985 | Graham | |
| 5,014,706 | A | 5/1991 | Philipp | |
| 2001/0039746 | A1 | 11/2001 | Seiter | |
| 2003/0033733 | A1 * | 2/2003 | Brooks | 36/31 |
| 2003/0061738 | A1 * | 4/2003 | Grohninger | 36/89 |

FOREIGN PATENT DOCUMENTS

| | | |
|---|---|---|
| DE | 2709546 | 9/1978 |
| DE | 3508582 A1 | 9/1986 |
| EP | 0752216 A2 | 1/1997 |
| WO | WO 99/53785 | 10/1999 |

* cited by examiner

*Primary Examiner*—Ted Kavanaugh
(74) *Attorney, Agent, or Firm*—William H. Eilberg

(57) ABSTRACT

A plantar insole has bearing areas (6, 7, 8, 9) of the main surface which are provided with a rigidity or hardness which are less with respect to other areas (10-13) of the main surface. These areas (6-9) are arranged under the major bearing areas of a foot, i.e. under toes, under the metatarsal heads, under the heel and under the external bearing area of the foot, making it possible to attain a compromise between the necessity of an impact absorption and stabilization of the foot in a shoe. The insole may be adapted to any type of footwear.

9 Claims, 4 Drawing Sheets

SELECTIVELY DAMPING PLANTAR INSOLE

TECHNICAL FIELD OF THE INVENTION

The present invention concerns plantar insoles for use in footwear between a sole of the footwear and the plantar surface of a user's foot.

Prior art plantar insoles are generally limited by a main upper surface that is adapted to be in contact with the plantar surface of the foot, by a lower surface that is adapted to be in contact with the sole of the footwear and by a peripheral contour conformed to fit inside the interior contour of the footwear.

Plantar insoles generally have the object of size or shape compensation for a better fit of the footwear to the foot of the user. The thickness of the plantar insole is selected for this purpose, and may vary as a function of the areas concerned beneath the foot of the user.

Moreover, footwear has already been designed in which the insole integrated into the footwear has properties of damping shocks in use.

Thus the document U.S. Pat. No. 4,364,189 A describes footwear in which the insole comprises a foam material that is more dense or more stiff in one of the two halves along the longitudinal axis of the foot. This does not achieve sufficient quality of damping and stability of a shoe, especially a sports shoe.

The document U.S. Pat. No. 4,551,930 A describes a harder or stiffer foam material all around the perimeter of the integral insole of a shoe. Damping and stability are somewhat improved, but still insufficiently.

The document U.S. Pat. No. 4,128,950 A describes a harder or stiffer foam material around the perimeter of the heel region. Stability is slightly improved, but to the detriment of damping.

The document EP 0 752 216 A describes footwear in which the integral insole has diverse distributions of hardness. However, the structures described do not achieve a good compromise between damping and the stability of the foot in the shoe.

Also, the documents cited above necessitate particular structures of footwear with integrated insoles and their solutions cannot be adapted to all types of footwear.

A function of massaging the sole of the foot has also been looked for.

Accordingly, the document DE 35 08 582 A describes an insole that has on its upper side isolated convex elastic areas constituting massage cushions. These massage cushions are placed in the reflex regions of the foot, to act on those regions. The reflex regions described are clearly separated from the bearing regions of the foot or cover only a small portion of those bearing regions.

The document US 2001/0039746 A1 describes an insole including convex elastic regions constituting massage cushions intended to improve venous circulation. The massage cushions described are not specifically placed in the bearing regions of the foot: most are separate from the bearing areas, and the others cover only parts of certain bearing regions.

The documents DE 27 09 546 A and WO 99/53785 describe an insole having a continuous elastic region that does not individualize the bearing regions of the foot; also, certain bearing regions are not covered.

The document U.S. Pat. No. 5,014,706 describes an orthopedic insole that modifies the pathological bearing areas of deformed feet. Elastic insole regions are placed to compensate the deformations. These regions are not specifically and individually concerned with the normal bearing areas of the foot.

Until now, a plantar insole has not had the combined function of improving damping and the stability of the foot in the footwear.

SUMMARY OF THE INVENTION

The problem addressed by the present invention is that of designing means that can be fitted to most footwear to provide at one and the same time effective damping of shocks to the foot when walking or running and simultaneously excellent stability of the foot in the shoe to prevent relative movement of the foot relative to the shoe during walking, running and lateral or rotation movements during changes of direction.

It is known in the art that insufficient support of the foot in a shoe can lead to instability in response to longitudinal, lateral or rotation forces between the foot and the shoe. It is also known in the art that, in use, the foot is subjected to shocks. Insufficient stability and inappropriate damping can increase the risk of joint and tendon damage and reduce comfort.

The invention stems from the observation that comfort can be significantly improved and the risk of joint and tendon damage significantly reduced by combining effective selective damping of the major bearing regions of the foot in the shoe, and specific and individual lateral support of those major bearing regions of the foot that improves the stability of the foot in the shoe to prevent the tendency for the shoe to come off or for the foot to slip inside the shoe during the movements of walking, running and changing direction.

The invention further aims to provide means of the above kind that are particularly robust and effective and adapted to use in any type of footwear.

To achieve the above and other objects, the invention proposes a plantar insole for use in footwear between an insole of the footwear and the plantar surface of a foot, the plantar insole being delimited by a main upper surface adapted to be in contact with the plantar surface of the foot, by a main lower surface adapted to be in contact with the footwear insole and by a peripheral contour conformed to extend beyond the plantar surface of the foot and to fit inside the interior contour of the footwear, the plantar insole having at least two different stiffnesses or hardnesses as a function of the main surface regions concerned; according to the invention:

- the insole has, on its main surface, bearing regions disposed to lie under each of the major bearing areas of the foot,
- the bearing regions have a relative stiffness or hardness lower than that of the other regions of the main surface, and
- the bearing regions are delimited by a contour flanking said major bearing regions of the foot.

The combination of the specific shapes and specific locations of the regions of relatively lower stiffness or hardness and of the vertical positioning of those regions as close as possible to the foot of the user effectively solves the problem that the invention addresses.

In practice, the invention determines four bearing regions in the main surface, corresponding to four major bearing regions of the foot in the commonest form of use. Accordingly, in one advantageous embodiment, the bearing regions on the main surface of lower relative stiffness or hardness comprise an anterior bearing region adapted to lie under the toes of the foot, an intermediate bearing region adapted to lie under the metatarsal heads of the foot, a posterior bearing region intended to lie under the heel of the foot, and an external bearing region intended to lie under the antero-external portion of the calcaneum, under the cuboid and under the fifth metatarsal of the foot.

The main surface regions of higher relative stiffness or hardness preferably comprise a peripheral border entirely surrounding the bearing regions of lower relative stiffness or hardness. This significantly improves stability.

The production of the above kind of plantar insole may be simplified if the main surface bearing regions of lower relative stiffness or hardness all have the same lower relative stiffness or hardness.

Good results may be obtained if the lower relative stiffness or hardness is from 20 to 35 Shore A.

Similarly, to simplify the structure of the plantar insole and its production, the main surface regions of higher relative stiffness or hardness may all have the same higher relative stiffness or hardness.

In this case, the higher relative stiffness or hardness may be from 38 to 50 Shore A.

In practice, the mean morphology of users may provide a basis for determining the regions of different hardness. Accordingly, for a plantar insole of size 42:

- the anterior bearing region is circumscribed in a polygon defined by the following vectors: ab (2.6 cm, 240°), bc (2.6 cm, 1.80°), cd (0.9 cm, 120°), de (1.9 cm, 50°), ef (6.3 cm, 120°), fg (2.5 cm, 0°), gh (5 cm, 310°), hi (1.6 cm, 270°), ia (0.8 cm, 0°);
- the combination formed by the intermediate bearing region, the posterior bearing region and the external bearing region is circumscribed in a polygon defined by the following vectors: jk (2.2 cm, 270°), kl (4.6 cm, 180°), lm (2.2 cm, 90°), mn (1.1 cm, 0°), no (3.7 cm, 105°), op (4.8 cm, 195°), pq (7.7 cm, 215°), qr (3.7 cm, 160°), rs (3.2 cm, 90°), st (1.8 cm, 35°), tu (14.8 cm, 10°), uv (4.3 cm, 305°), vj (1.7 cm, 270°).

In an embodiment adapted to mass production in limited quantity, the plantar insole of the invention may be constituted by assembling by sticking a first elastomer material constituting the regions of higher relative stiffness or hardness and a second elastomer material constituting the bearing regions of lower relative stiffness or hardness, with sticking on an antibacterial upper film and a comfort fabric.

BRIEF DESCRIPTION OF THE DRAWINGS

Other objects, features and advantages of the present invention will emerge from the following description of particular embodiments of the invention given with reference to the appended drawings, in which.

DESCRIPTION OF PREFERRED EMBODIMENTS

The embodiment of a plantar insole of the invention shown in the figures is delimited by a main upper surface 1, a main lower surface 2 and a peripheral contour 3.

The main lower surface 2 is adapted to be in contact with a footwear insole. In the embodiment shown, it may be fitted into footwear whose bearing surface is undulated in the longitudinal direction to follow the usual general anatomical curvature of the foot and the bearing surface whereof is concave in the transverse direction. The peripheral contour 3 is conformed to fit inside the interior contour of the footwear, and to this end has, in plan view, the usual curves of the peripheral contours of prior art plantar insoles.

At rest, the main upper surface 1 has the usual general shape for plantar insoles, and this shape may vary without departing from the scope of the present invention.

Figure 2:
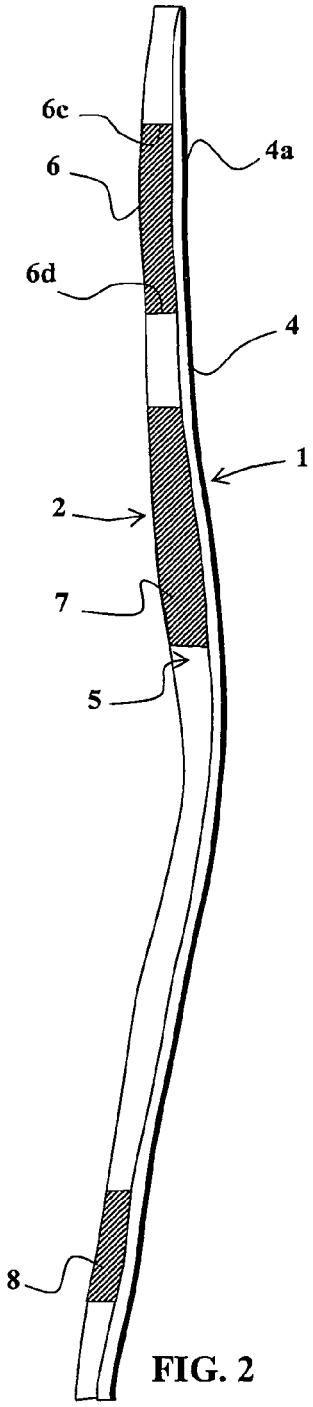
FIGS. 2, 3 and 4 are side views in longitudinal section of the FIG. 1 insole taken along the lines II-II, III-III, IV-IV, respectively, in FIG. 1.
Figure 3:
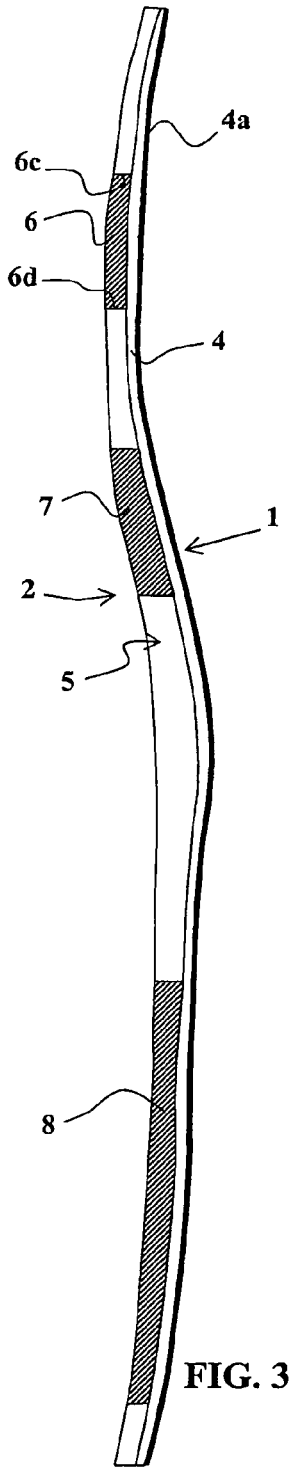
Figure 4:
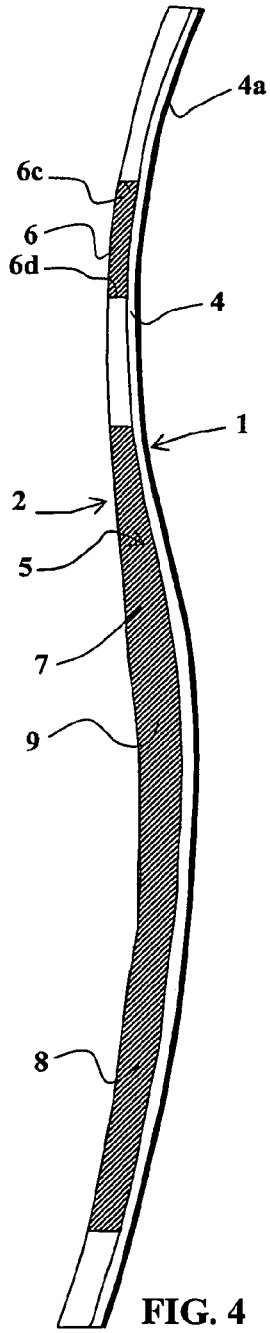
Figure 5:
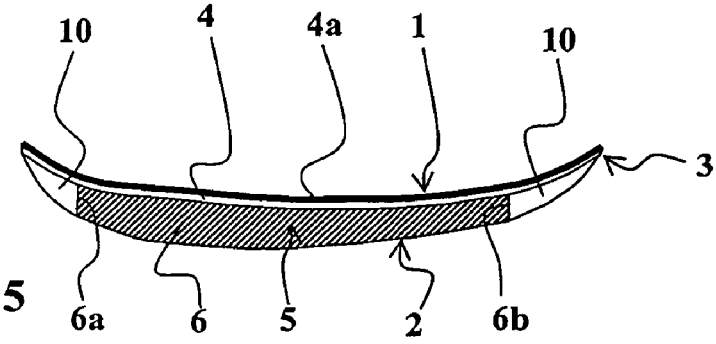
FIGS. 5, 6, 7 and 8 are cross-sections of the FIG. 1 insole taken along the lines V-V, VI-VI, VII-VII and VIII-VIII respectively in FIG. 1.
Figure 6:
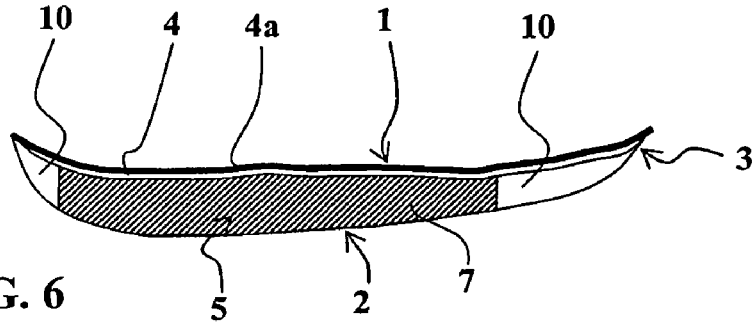
Figure 7:
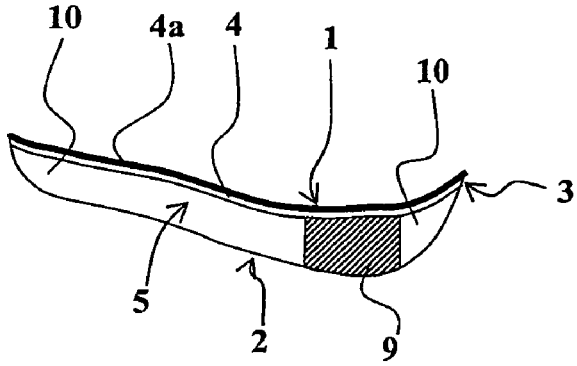
Figure 8:
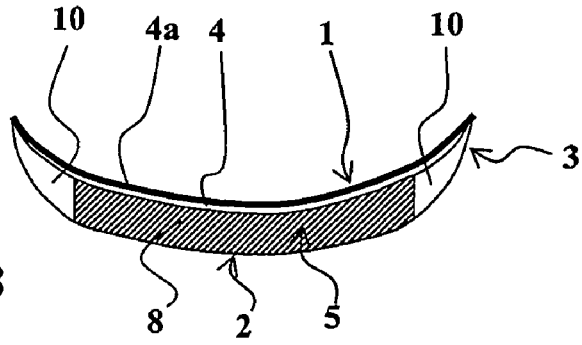

Accordingly, in the embodiment shown in FIGS. 2 to 4, the thickness of the plantar insole varies slightly along a given longitudinal plane and varies as a function of the transverse position of the longitudinal plane concerned. This thickness may be greater than the central region under the sole of the foot, and lower in the end regions. This produces a compensating effect.

Similarly, in the same embodiment shown in FIGS. 5 to 8, the thickness of the plantar insole varies along the same transverse plane concerned and varies as a function of the transverse plane concerned.

In a practical embodiment shown in the figures, relating to an insole of size 42, consider the median longitudinal plane X-X of the insole, corresponding to the sagittal plane of the foot, the longitudinal plane II-II at a distance of approximately 20 mm from the plane X-X in the direction of the inside edge of the insole, the longitudinal plane III-III at a distance of approximately 10 mm from the plane X-X in the direction of the outside edge of the insole, and the longitudinal plane IV-IV at a distance of approximately 33 mm from the X-X plane in the direction of the external edge of the insole. In the section in the plane II-II shown in FIG. 2, the thickness of the insole at the anterior end may be of the order of 6 mm, while its thickness in a median area may be of the order of 11 mm and its thickness at the posterior end may be of the order of 9 mm. Similarly, in the section in the plane III-III, the front thickness is of the order of 6 mm, the central thickness is of the order of 12 mm, and the posterior thickness is of the order of 8 mm. Finally, in the plane IV-IV, the anterior thickness is of the order of 6 mm, the central thickness is of the order of 10 mm and the posterior thickness is of the order of 8 mm.

The thicknesses are given by way of illustrative example and are liable to vary as a function in particular of the damping to be achieved. Thus increased thicknesses may be selected to increase the damping properties, or vice versa.

Consider next the transverse planes relative to the front end 1*a* of the insole: the plane V-V is approximately 5.5 cm from the front end of the insole, the plane VI-VI is approximately 11 cm from the front end of the insole, the plane VII-VII is approximately 16.5 cm from the front end of the insole and the plane VIII-VIII is approximately 22 cm from the front end of the insole.

In each of the transverse planes, the thickness of the insole decreases to nothing along the inside edge and along the outside edge. The central thickness varies as a function of the transverse plane concerned. Moreover, the main lower surface 2 is convex, whereas the main upper surface 1 is concave. Accordingly, in the plane V-V shown in FIG. 5, the concavity of the main upper surface 1 forms a recess approximately 5 mm deep, and likewise in the transverse plane VI-VI shown in FIG. 6. In the transverse plane VIII-VIII shown in FIG. 8, the recess is approximately 12 mm deep.

The length of the size 42 insole is 27.5 cm. Its width varies as a function of the transverse plane concerned: the width is approximately 8.5 cm in the transverse plane V-V, approximately 9.5 cm in the plane VI-VI, approximately 7.5 cm in the plane VII-VII and approximately 7 cm in the plane VIII-VIII.

The embodiment of the plantar insole shown in FIGS. 2 to 4 comprises a basic structure 5 to which is fixed an upper film 4 that is itself preferably covered with a comfort fabric 4*a* constituting the upper surface 1 and adapted for contact with the skin of the foot. The upper film 4 may advantageously be made from an antibacterial material with a thickness of the order of 1 mm. There may therefore be chosen for the basic structure 5 a different material, adapted to the required effects, compatibility of which with contact with the foot is not required.

The plantar insole of the invention is intended to cooperate with the foot in a particular way, to provide the functions of effective damping of shocks to the foot and of stability of the foot in the shoe during the movements of walking, running, rotating or changing direction.

Figure 9:
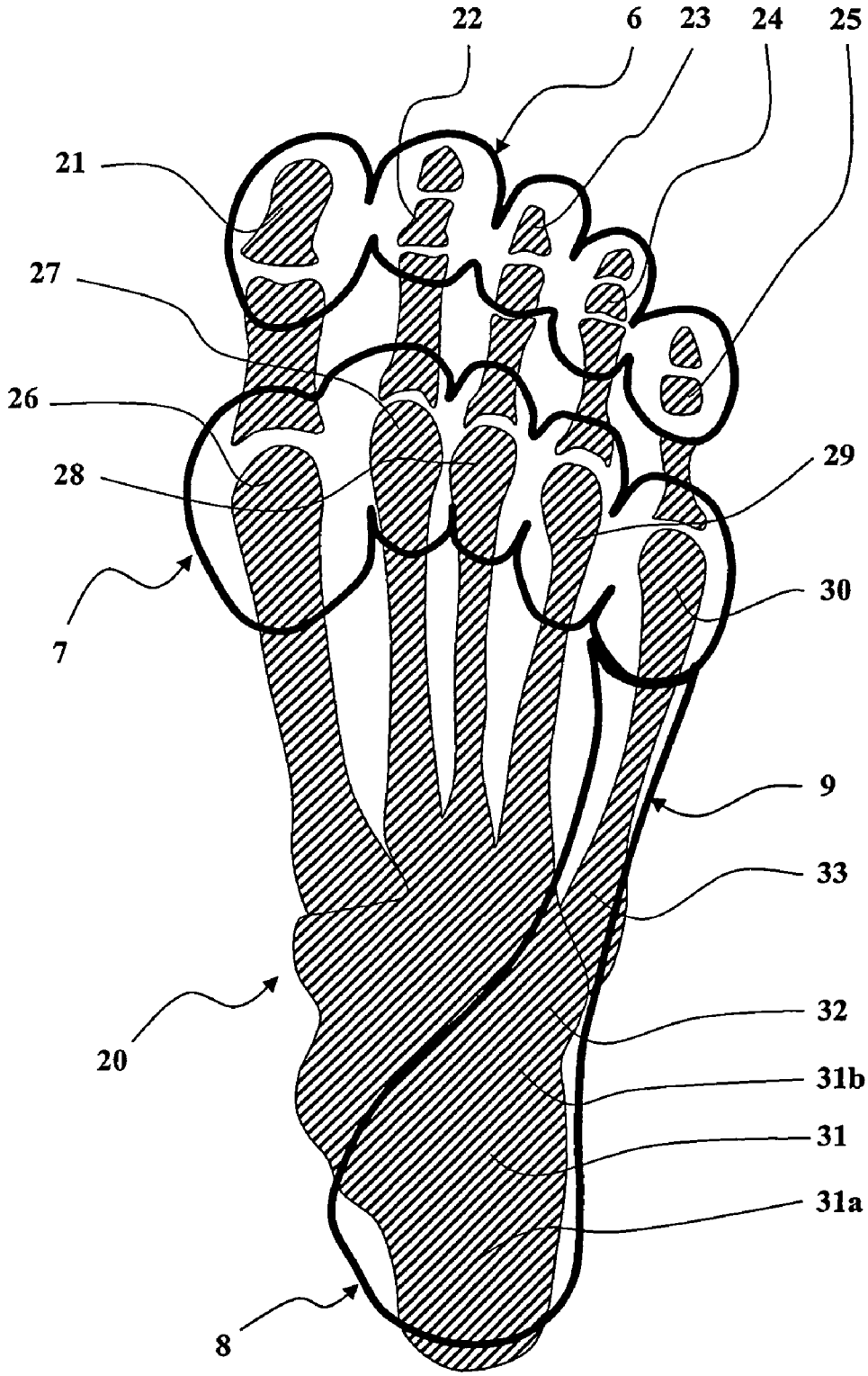
FIG. 9 is a plan view showing the relative position of the bearing regions of the insole and portions of the skeleton of the foot constituting the major bearing regions of the foot.

To this end, the insole essentially cooperates with the major bearing areas of the foot, which are shown in FIG. 9.

That FIG. 9 shows in plan view the horizontal projection of the skeleton 20 of the foot. There can be seen the toes 21, 22, 23, 24 and 25, the metatarsal heads 26, 27, 28, 29 and 30, the calcaneum 31 that has a posterior portion 31*a* constituting the heel and an antero-external portion 31*b*, an external portion of the cuboid 32, and finally the fifth metatarsal 33.

The toes 21-25 constitute a first major bearing region of the foot. The metatarsal heads 26-30 constitute a second major bearing region of the foot. The posterior portion 31*a* of the calcaneum, or heel, constitutes a third major bearing region of the foot, together with the antero-external portion 31*b* of the calcaneum, with the cuboid 32 and with the body of the fifth metatarsal 33.

Referring again to FIG. 1, it is seen that the main upper surface 1 of the insole of the invention comprises separate regions, which have different mechanical properties.

Figure 1:
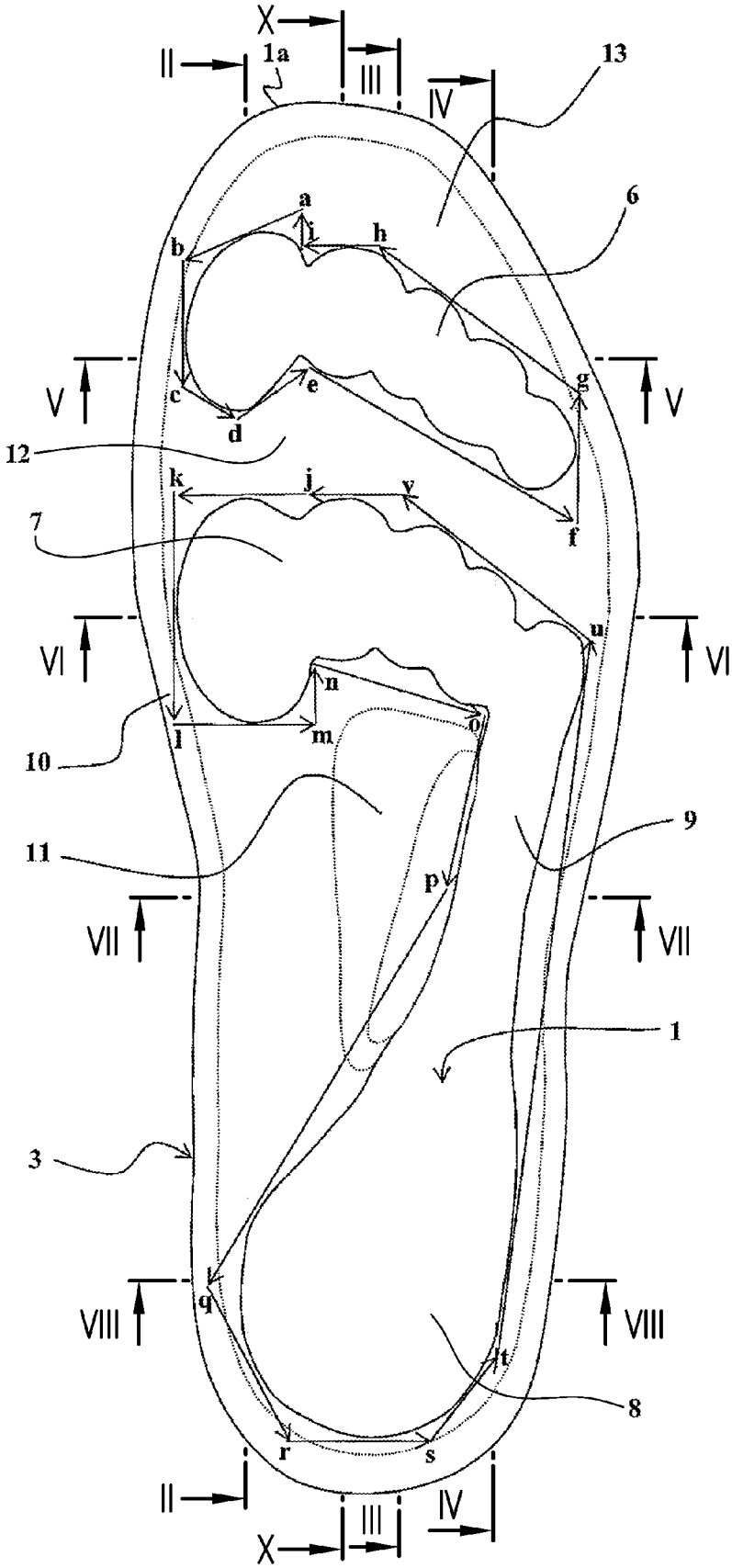
FIG. 1 is a view of the main upper surface of one embodiment of a right foot plantar insole of the present invention.

Consider the main upper surface 1, shown in FIG. 1, from which the upper film 4 and the comfort fabric 4*a* have been removed. There are seen an anterior bearing region 6 designed to go under the toes 21-25 of the user's foot, an intermediate bearing region 7 designed to go under the metatarsal heads 26-30 of the user's foot, a posterior bearing region 8 designed to go under the heel of the user's foot and an external bearing region 9 designed to go under the antero-external portion of the calcaneum 31*b*, under the cuboid 32 and under the fifth metatarsal 33 of the user's foot.

The relative position of the bearing regions 6-9 of the insole and the major bearing regions of the foot is seen better in FIG. 9. As may be seen in that figure, the anterior bearing region 6 is delimited by a continuous contour that flanks the first major bearing region of the foot consisting of the toes 21-25. In other words, the contour of the anterior bearing region 6 is relatively close to the contour of the toes 21-25, following that contour relatively faithfully, as shown in FIG. 9. Similarly, the intermediate bearing region 7 is delimited by a contour that flanks the second major bearing region of the foot consisting of the metatarsal heads 26-30. This contour of the intermediate bearing region 7 follows fairly faithfully the contour of the metatarsal heads 26-30, as shown in FIG. 9. The posterior bearing region 8 is also delimited by a contour that flanks the major bearing region of the foot consisting of the heel 31*a*, as may be seen in FIG. 9. Finally, the external bearing region 9 is delimited by a contour that closely flanks the major bearing region of the foot consisting of the antero-external portion of the calcaneum 31*b*, the cuboid 32 and the fifth metatarsal 33, as shown in FIG. 9.

The bearing regions 6, 7, 8 and 9 defined above constitute main surface regions of the main surface 1 having a lower relative stiffness or hardness.

The rest of the plantar insole constitutes main surface regions having a higher relative stiffness or hardness.

The regions of higher relative stiffness or hardness comprise a peripheral border 10 that entirely surrounds the bearing regions 6, 7, 8 and 9 of lower relative stiffness or hardness. There are also a plantar region 11, an intermediate transverse region 12 and an anterior end region 13 having a higher relative stiffness or hardness.

When the foot presses on the plantar insole, the main surface bearing regions of lower relative stiffness or hardness, namely the anterior bearing region 6, the intermediate bearing region 7, the posterior bearing region 8 and the external bearing region 9, receive the major bearing regions of the foot, and are therefore subjected to the highest mechanical forces of the foot. They are deformed elastically by the foot. Because their relative stiffness or hardness is lower, the anterior bearing region 6, intermediate bearing region 7, posterior bearing region 8 and external bearing region 9 deform more under load, favoring a certain localized depression of the foot in these regions, at the same time as amplifying the effects of peripheral and intermediate support by the other adjacent plantar insole regions having a higher relative stiffness or hardness and that are not deformed much. The result of this is, at one and the same time, good damping of shocks thanks to the deformation of the bearing regions of lower relative stiffness or hardness and better stability of the foot in the shoe thanks to the smaller deformation of the adjacent main surface regions of higher relative stiffness or hardness.

The stiffness or hardness of the bearing regions of lower relative stiffness or hardness may be from 20 to 35 Shore A. Similarly, the stiffness or hardness of the regions of higher relative stiffness or hardness may be from 38 to 50 Shore A, advantageously with a hardness difference of at least 10 Shore A between the higher relative hardness and the lower relative hardness, and preferably with a hardness difference of at least 15 Shore A.

In practice, the bearing regions 6, 7, 8 and 9 of lower relative stiffness or hardness may have curvilinear contours as shown in FIGS. 1 and 9, the anterior bearing region 6 consisting of five associated oval regions each corresponding to one of the toes, the intermediate bearing region 7 also consisting of five oval regions each corresponding to one of the metatarsal heads of the foot, the posterior bearing region 8 being of oval or circular shape adapted to the shape of the heel of the user's foot, and the external bearing region 9 having a width that decreases progressively from the posterior region 8 to the intermediate bearing region portion 7 corresponding to the fifth metatarsal head.

These bearing regions 6-9 of low relative stiffness or hardness may also be defined by inscribing them in two polygons defined as follows.

For an insole of size 42, the anterior bearing region 6 is circumscribed in a polygon abcdefghi in which the origin point a is approximately 1.6 cm to the rear of the edge of the anterior summit of the plantar insole and approximately 1.1 cm from the median plane X-X in the direction of the interior edge of the insole; the sides of the polygon are identified by the corresponding vectors of their length and their angle in the clockwise direction from the median longitudinal axis X-X considered from the rear toward the front of the plantar insole as seen from above: ab (2.6 cm, 240°), bc (2.6 cm, 180°), cd (0.9 cm, 120°), de (1.9 cm, 50°), ef (6.3 cm, 120°), fg (2.5 cm, 0°), gh (5 cm, 310°), hi (1.6 cm, 270°), ia (0.8 cm, 0°).

The intermediate bearing region 7, the posterior bearing region 8 and the external bearing region 9 form a set circumscribed in a polygon defined in a similar way, starting from an origin point j which is 1.1 cm from the median longitudinal axis X-X in the direction of the inside edge of the plantar insole and 7.6 cm to the rear of the anterior edge of the plantar insole, the following vectors are drawn: jk (2.2 cm, 270°), kl (4.6 cm, 180°), lm (2.2 cm, 90°), mn (1.1 cm, 0°), no (3.7 cm, 105°), op (4.8 cm, 195°), pq (7.7 cm, 215°), qr (3.7 cm, 160°), rs (3.2 cm, 90°), st (1.8 cm, 35°), tu (14.8 cm, 10°), uv (4.3 cm, 305°), vj (1.7 cm, 270°).

The position and the size of the bearing regions of lower relative stiffness or hardness can also be seen clearly in FIGS. 2 to 4 in longitudinal section and in FIGS. 5 to 8 in cross section. In the cross sections, there is a clear distinction between the distribution of the main surface bearing regions of lower relative stiffness or hardness and the main surface regions of higher relative stiffness or hardness. In particular, in the section in the plane V-V shown in FIG. 5, the peripheral border 10 is approximately 10 mm wide along the inside edge of the insole and approximately 15 mm wide along the outside edge of the insole; in section in the plane VI-VI shown in FIG. 6, the peripheral border 10 is approximately 6 mm wide along the inside edge and approximately 25 mm along the outside edge; in section in the plane VII-VII shown in FIG. 7, the peripheral border is very wide along the inside edge and is approximately 12 mm wide along the outside edge; finally, in section in the plane VIII-VIII shown in FIG. 8, the peripheral border 10 is approximately 12 mm wide along the inside edge and approximately 14 mm wide along the outside edge.

Considering the cross sections in the planes V-V, VI-VI, VII-VII and VIII-VIII shown in FIGS. 5 to 8, respectively, it is clear that the disposition of the upper surface bearing regions of lower relative hardness, surrounded by adjacent upper main surface regions of higher relative hardness, promotes effective lateral retention of the insole on the foot and opposes any sliding or rotation of the insole relative to the foot. For example, it is clear in FIG. 5 that, as a result of the deformation under load of the anterior bearing region 6, the first major bearing region of the foot consisting of the toes 21-25 is guided laterally at the ends 6*a* and 6*b* of the anterior bearing region 6 by the adjacent portions of the insole of higher relative stiffness or hardness, consisting in the present instance of the lateral portions of the peripheral border 10, which are deformed less and constitute a lateral rim.

Similarly, considering the FIG. 3 longitudinal section, it is clear that the first major bearing region of the foot consisting of the toes 21-25 deforms under load the anterior bearing region 6 and is guided longitudinally at the ends 6*c* and 6*d* of the anterior bearing region 6 by the adjacent portions of the insole made from a material of higher relative stiffness or hardness. This significantly improves the stability of the foot in the shoe, or the stability of the shoe on the foot, during movements of changing direction, walking and running in particular.

The above ranges, determined for a size 42, are susceptible to variations of plus or minus 3 mm in width and in length.

As is standard practice in the footwear industry, other sizes are determined by homothetic transformation.

The upper film 4 and the comfort fabric 4*a* are sufficiently thin and flexible not to affect the efficacy of the basic structure 5 with regions of different relative hardness.

One embodiment provides an insole made entirely from an elastomer material whose hardness is equal to the higher relative stiffness or hardness, cutting out regions intended to have a lower relative stiffness or hardness, sticking into the regions cut out in this way sheets of a material of lower relative stiffness or hardness, and then sticking on the antibacterial upper film 4 and the comfort fabric 4*a*. The materials constituting the insole body may be closed cell foam elastomers of appropriate density to produce the required hardness. Good results have been obtained using as the material of the main upper surface regions of higher relative stiffness or hardness the trademark ALCAFORM BIANCO material having a density of 200, while the material forming the bearing regions 6-9 or main surface regions of lower relative stiffness or hardness is the trademark NORA LUMARMIDE material having a density close to 100 or 110.

The present invention is not limited to the embodiments that have been described explicitly, and encompasses variants and generalizations thereof that fall within the scope of the following claims.

The invention claimed is:

1. Plantar insole for use in footwear between an insole of the footwear and the plantar surface of a foot, the plantar insole being delimited by a main upper surface adapted to be in contact with the plantar surface of the foot, a main lower surface adapted to be in contact with the footwear insole and a peripheral contour conformed to extend beyond the plantar surface of the foot and to fit inside the interior contour of the footwear, the plantar insole having at least two different stiffnesses or hardnesses as a function of the main surface regions concerned, wherein:

the insole has, on its main surface, bearing regions disposed to lie under each of the major bearing areas of the foot, the bearing regions have a relative stiffness or hardness lower than that of the other regions of the main surface, and the bearing regions are delimited by a contour flanking said major bearing regions of the foot, wherein the bearing regions comprise an anterior bearing region adapted to lie under the toes of the foot, an intermediate bearing region adapted to lie under the metatarsal heads of the foot, a posterior bearing region intended to lie under the heel of the foot, and an external bearing region intended to lie under the antero-external portion of the calcaneum, under the cuboid and under the fifth metatarsal of the foot.

2. Plantar insole according to claim 1, wherein the main surface regions of higher relative stiffness or hardness comprise a peripheral border entirely surrounding the bearing regions of lower relative stiffness or hardness.

3. Plantar insole according to claim 1, wherein the main surface bearing regions of lower relative stiffness or hardness all have the same lower relative stiffness or hardness.

4. Plantar insole according to claim 3, wherein said lower relative stiffness or hardness is from 20 to 35 Shore A.

5. Plantar insole according to claim 1, wherein the main surface regions of higher relative stiffness or hardness all have the same higher relative stiffness or hardness.

6. Plantar insole according to claim 5, wherein said higher relative stiffness or hardness is from 38 to 50 Shore A.

7. Plantar insole according to claim 1, wherein, for a plantar insole of size 42:

the anterior bearing region is circumscribed in a polygon defined by the following vectors: ab (2.6 cm, 240°), bc (2.6 cm. 180°), cd (0.9 cm, 120°), de (1.9 cm, 50°), ef (6.3 cm, 120°), fg (2.5 cm, 0°), gh (5 cm, 310°), hi (1.6 cm, 270°), ia (0.8 cm, 0°);

the combination formed by the intermediate bearing region, the posterior bearing region and the external bearing region is circumscribed in a polygon defined by the following vectors: jk (2.2 cm, 270°), kl (4.6 cm, 180°), lm (2.2 cm, 90°), mn (1.1 cm, 0°), no (3.7 cm, 105°), op (4.8 cm, 195°), pq (7.7 cm, 215°), qr (3.7 cm, 160°), rs (3.2 cm, 90°), st (1.8 cm, 35°), tu (14.8 cm, 10°), uv (4.3 cm, 305°), vj (1.1 cm, 270°).

8. Plantar insole according to claim 1, wherein the thickness of the plantar insole varies along its length with a greater thickness in the central region and a lesser thickness in the end regions, considering the length of the plantar insole.

9. Plantar insole according to claim 1, wherein it is constituted by assembling by sticking a first elastomer material constituting the regions of higher relative stiffness or hardness and a second elastomer material constituting the bearing regions of lower relative stiffness or hardness, with sticking on an antibacterial upper film and a comfort fabric.

* * * * *